US006581943B2

(12) United States Patent
Wegener

(10) Patent No.: US 6,581,943 B2
(45) Date of Patent: Jun. 24, 2003

(54) H-BLOCK DEVICE FOR IN-LINE SKATES

(75) Inventor: Andreas C. Wegener, Encinitas, CA (US)

(73) Assignee: Sunshine Distribution, Inc., Vista, CA (US)

( * ) Notice: Subject to any disclaimer, the term of this patent is extended or adjusted under 35 U.S.C. 154(b) by 0 days.

(21) Appl. No.: 09/801,849

(22) Filed: Mar. 8, 2001

(65) Prior Publication Data

US 2002/0125660 A1 Sep. 12, 2002

(51) Int. Cl.[7] ..... A63C 3/12

(52) U.S. Cl. ..... 280/11.221; 280/809; 280/11.27

(58) Field of Search ..... 280/809, 811, 280/11.19, 11.12, 11.221, 11.27, 11.231; 36/115, 132

(56) References Cited

U.S. PATENT DOCUMENTS

| | | | | | |
|---|---|---|---|---|---|
| 250,319 | A | | 11/1881 | Yates | |
| 4,214,768 | A | * | 7/1980 | Dominey et al. | 280/809 |
| 4,273,345 | A | | 6/1981 | Ben-Dor et al. | |
| 4,323,259 | A | * | 4/1982 | Boudreau | 280/809 |
| 4,928,982 | A | | 5/1990 | Logan | |
| 5,183,276 | A | | 2/1993 | Pratt | |
| 5,234,230 | A | | 8/1993 | Crane | |
| 5,327,329 | A | | 7/1994 | Stiles | |
| 5,411,278 | A | | 5/1995 | Wittmann | |
| 5,456,478 | A | | 10/1995 | Hsu et al. | |
| 5,566,958 | A | | 10/1996 | Sinelnikov et al. | |
| 5,630,624 | A | * | 5/1997 | Goodman | 280/809 |
| 5,772,220 | A | | 6/1998 | Gaster | |
| 5,806,860 | A | | 9/1998 | Conte | |
| 5,836,591 | A | | 11/1998 | Roderick et al. | |
| 5,967,552 | A | * | 10/1999 | Roderick et al. | 280/809 |
| 6,006,450 | A | * | 12/1999 | Hayes | 36/115 |
| 6,029,983 | A | | 2/2000 | Wegener | |
| 6,041,525 | A | * | 3/2000 | Kelley | 36/115 |
| 6,070,886 | A | * | 6/2000 | Cornelius et al. | 280/11.22 |
| 6,089,580 | A | * | 7/2000 | Borel et al. | 280/11.27 |
| 6,105,978 | A | * | 8/2000 | Vuerchoz | 280/11.27 |
| 6,142,489 | A | * | 11/2000 | Borel | 280/11.22 |
| 6,247,251 | B1 | * | 6/2001 | James | 36/115 |
| 6,416,081 | B1 | * | 7/2002 | Goodman | 280/809 |

* cited by examiner

*Primary Examiner*—Brian L. Johnson
*Assistant Examiner*—Jeffrey J Restifo
(74) *Attorney, Agent, or Firm*—Brown Martin Haller & McClain LLP

(57) ABSTRACT

An in-line skate apparatus has a frame for attachment to the sole of a shoe with a pair of outer, substantially flat side faces, a front end, a rear end, and a lower edge. A plurality of wheels are rotatably mounted on the frame in a line from the front end to the rear end of the frame, and a cut out extends upwardly from the lower edge between an adjacent pair of wheels. A separate H-block is releasably mounted in the cut-out so as to substantially fill the cut-out, and has a width at least equal to the width of the frame, so that its outer side faces are substantially flush with the outer side faces of the frame. The H-block has an arcuate, downwardly directed sliding region extending across its width and along at least part of the height of each side face, whereby the sliding region of the H-block includes the only sliding surface of the apparatus during sliding maneuvers.

6 Claims, 2 Drawing Sheets

H-BLOCK DEVICE FOR IN-LINE SKATES

BACKGROUND OF THE INVENTION

The present invention relates generally to single-track roller skates of the type generally known as "in-line skates" or roller blades.

In-line skates generally have four or five wheels arranged one after the other in a single line in the running direction. The wheels are rotatably mounted on a frame or chassis, and the frame is connected with the sole of the shoe or may be integrated into the sole of the shoe. An example of a skate of this type is described in my U.S. Pat. No. 6,029,983. Other examples are described in U.S. Pat. Nos. 5,411,278 of Wittman and U.S. Pat. No. 5,806,860 of Conte.

Typically, the frame of an in-line skate includes a pair of plates between which the rollers are rotatably mounted. In so-called extreme or stunt skates, the center of the lower edge of each plate is arched to provide a sliding surface for the skater to slide or grind along a railing, curbstone edge, or the like more easily. In some cases, a so-called "H-block" of a different material is mounted between the side plates in this region, with a similar arched, downwardly facing surface, to allow the skater to slide more easily along such edges. The H-block may be made of various materials in order to provide faster or slower sliding surfaces. One problem with such stunt skates is that repeated sliding or grinding of the plates against a pavement edge will cause abrasion and damage to the plates.

SUMMARY OF THE INVENTION

It is an object of the present invention to provide a new and improved H-block device for an in-line roller skate.

According to one aspect of the present invention, an in-line roller skate is provided, which comprises a frame for attachment to the underside of a shoe, the frame having a pair of spaced, parallel downwardly directed plates, a plurality of wheels rotatably mounted in a line between the plates, the plates each having an outer surface, and a lower edge, each lower edge having an upwardly indented, cut-out region of predetermined height between an adjacent pair of wheels, and a separate H-block mounted in the cut-out region of the plates, the H-block comprising a generally rectangular block having outer side faces substantially flush with the outer surface of the respective plates, and a downwardly directed, lower arcuate face, the lower arcuate face and outer side faces of the H-block together providing a sliding surface for sliding maneuvers.

In an exemplary embodiment, the cut-out region in each plate is generally rectangular and has a height equal to at least half of the overall height of the plate, so that the H-block completely replaces the outer surface of the plate in that region to form a grinding or sliding surface, protecting the frame surface against damage. If the H-block is damaged, it can be replaced much more easily and inexpensively than replacing the entire roller blade frame. The H-block may be made of any suitable material for providing a desired fast or slow sliding surface.

This invention prevents grinding damage to the frame sides in the grinding or sliding region, and instead completely replaces the frame sides in this area with an H-block. Thus, the sides of the H-block will be ground down or abraded, rather than the frame sides, and wear of the frame as a result of grinding stunts is substantially prevented.

BRIEF DESCRIPTION OF THE DRAWINGS

The present invention will be better understood from the following detailed description of an exemplary embodiment of the invention, taken in conjunction with the accompanying drawings in which like reference numerals refer to like parts and in which.

DETAILED DESCRIPTION OF THE DRAWINGS

Figure 1:
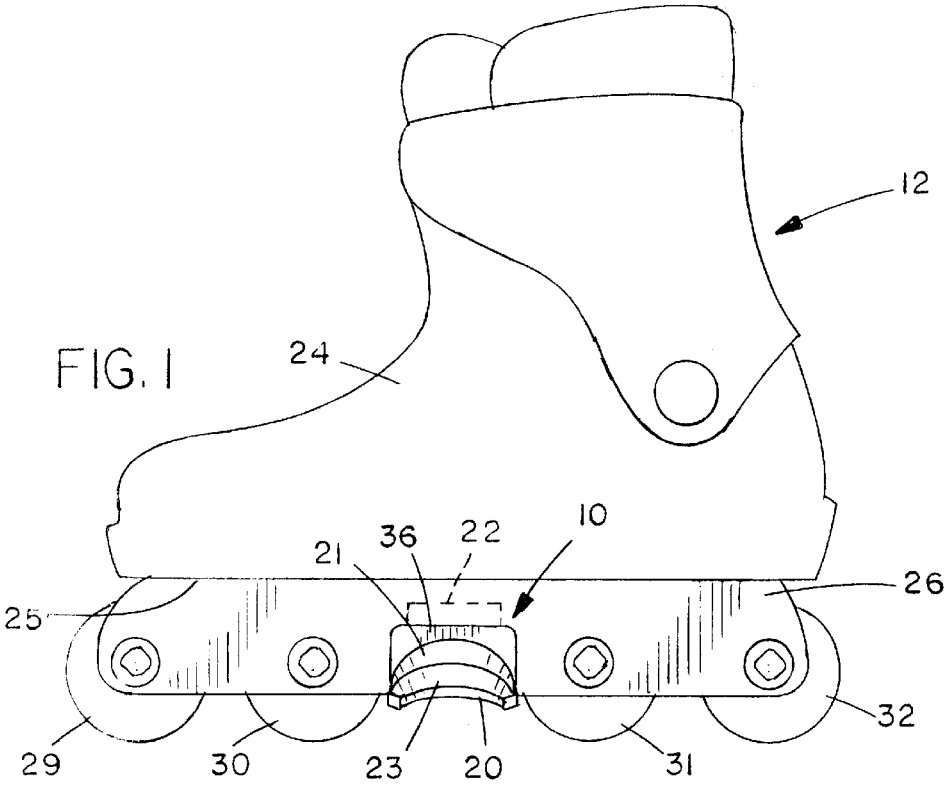
FIG. 1 is a side view of a typical in-line skate incorporating the model block according to an exemplary embodiment of the invention.
Figure 2:
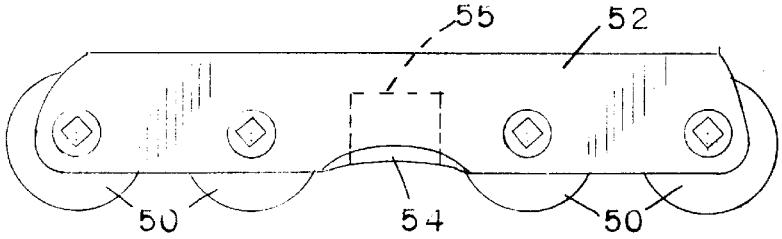
FIG. 2 PRIOR ART
FIG. 2 is a side view of the prior art wheel unit.
Figure 2A:
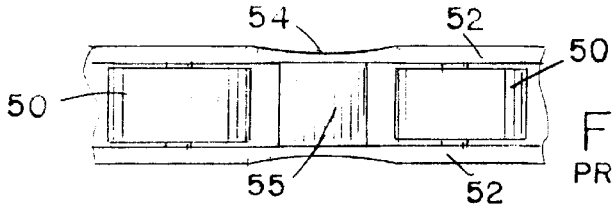
FIG. 2A PRIOR ART
FIG. 2A is a bottom plan view of the prior art unit of FIG. 2.
Figure 3:
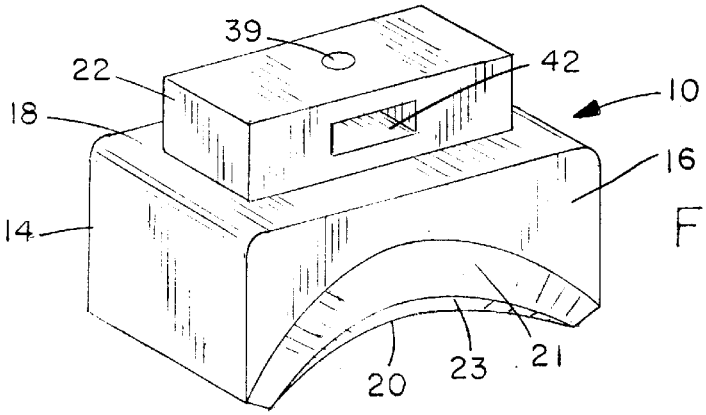
FIG. 3 is a perspective view of the block of FIG. 1.
Figure 4:
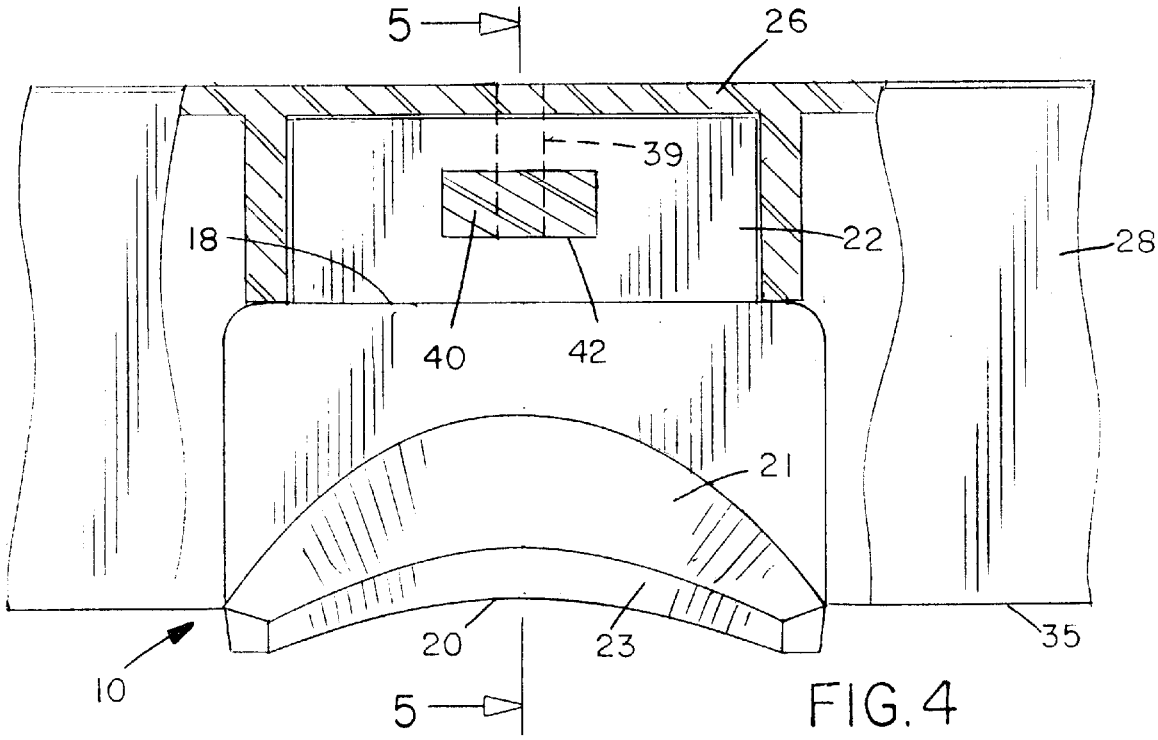
FIG. 4 is an enlarged side view of the central portion of the frame, cut away to show the block installation.
Figure 5:
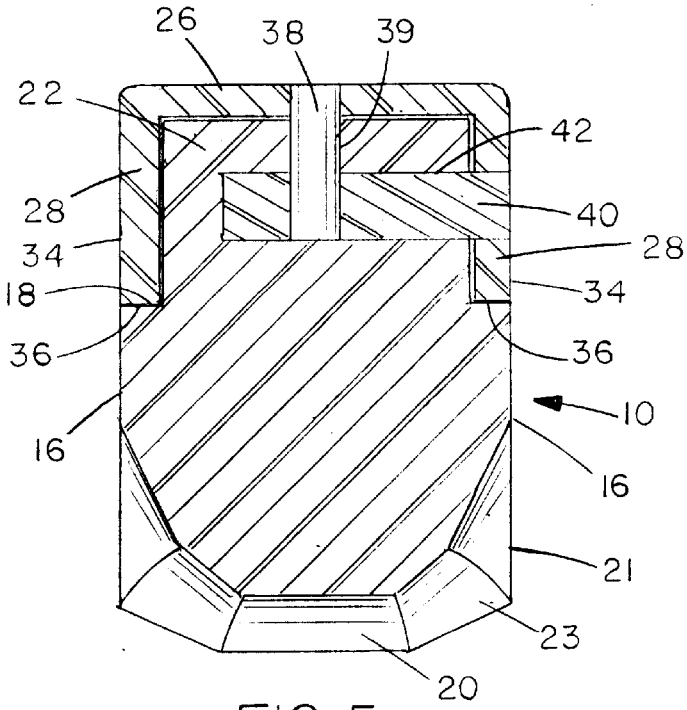
FIG. 5 is a sectional view taken on line 5—5 of FIG. 4.

FIG. 3 of the drawings illustrates an H-block device 10 according to an exemplary embodiment of the invention, while FIGS. 1, 4 and 5 illustrate the device 10 installed on an in-line skate 12. FIGS. 2 and 2A illustrate part of a prior art in-line skate for comparison purposes. The device 10 basically comprises a generally rectangular, solid block of a suitable rigid material such as plastic. The block has a pair of flat end walls 14, opposite side walls 16, a top face 18, and an arcuate, downwardly facing surface 20. A fastener portion or boss 22 projects upwardly from top face 18 for attachment of the block device 10 to the skate 12, as described in more detail below. The material of the device 10 is designed to provide a sliding surface, and may be of a selected smoothness depending on whether fast or slow sliding is desired. Curved portions 21, 23 of the side walls 16 extending down to the lower, arcuate face 20 are smoothly tapered inwardly to the face 20 to provide additional sliding edges.

As best illustrated in FIG. 1, the in-line skate 12 has an upper shoe part 24 and a sole 25 to which a chassis or frame 26 is attached. The frame 26 has a pair of downwardly directed, parallel plates 28 between which a series of four wheels 29, 30, 31 and 32 are rotatably mounted. Each plate 28 has an outer side face 34 and a lower edge 35. The lower edges 35 each have an upwardly directed, generally rectangular indent or cut-out 36 in a central region of the skate between the center two wheels 30 and 31. The block device 10 is releasably mounted in the cut-outs 36 to span the gap between the plates 28 with its side walls 16 substantially flush with the outer side faces 34 of the plates, as best illustrated in FIG. 4. The device 10 is held in position by means of a locking pin 38 extending through an opening in the upper part of frame 26 into a vertical bore 39 in the fastener boss 22 on the block 10. A transverse retaining key 40 projects inwardly through an opening in one of the side walls 28 into a bore 42 in boss 22 which intersects the vertical bore, as indicated in FIG. 4, and pin 38 extends through an aligned opening in key 40 to hold the block in position.

The block 10 therefore completely replaces the portions of the frame side walls adjacent the lower sliding face 20, so that the side walls will not come into contact with a pavement or railing edge when a skater is performing sliding or grinding stunts. The cut-outs 36 extend for a height equal to at least half of the overall height of each side plate of the frame, and the block 10 is of predetermined dimensions for spanning the gap between the side plates and extending outwardly to a location at least flush with the outer faces 34 of the side walls, as well as completely filling each of the cut-outs 36, as indicated in FIGS. 1 and 4. In an exemplary embodiment, each side plate had a height of around 48 mm, while the height of the block 10 from the upper face 18 down to the lower face was of the order of 25 to 35 mm.

FIGS. 2 and 2A illustrate a prior art H-block arrangement for comparison purposes. In prior art arrangements, a series of wheels 50 are rotatably mounted between a pair of side plates 52 of a frame, and the lower edges of the plates have an arcuate, downwardly facing sliding region 54 between the center pair of wheels. A slide or H-block 55 is mounted between the plates 52 at the sliding region 54, as indicated in FIG. 2A. The block 55 also has a downwardly directed, arcuate surface substantially matching that of the side plates, but is completely retained between the side plates, simply forming a continuation of their downwardly directed, arcuate sliding surfaces. The purpose of the prior art H-block is simply to provide a different sliding effect and speed, depending on whether slow or fast sliding material is selected for the block. However, after repeated grinding maneuvers are carried out, the sides of the frame in the sliding region will be abraded and worn, and the resultant damage will ultimately require replacement of the entire frame.

The H-block device 10 of this invention, together with the modified frame having a cut-out for receiving the block, completely avoids this problem since all sliding or grinding surfaces are provided on the block itself, and the skater will never be sliding or grinding on the outer surface of the frame side plates. The block extends outwardly to a position aligned or flush with the adjacent outer surface of each side plate, and is of a sufficient length and height to ensure that the skater will always be sliding or grinding on a portion of the H-block itself when performing stunts. As can be seen in FIG. 1, the H-block device has opposite end faces 14 adjacent the respective center wheels 30 and 31, and outer sides extending upwardly for over half of the height of the respective frame side plates, ensuring that the skater will always slide on a portion of the H-block, grinding the H-block, rather than the frame, against a pavement, rail, or other edge.

The H-block 10 is designed with improved articulating or grinding surfaces, with additional levels as illustrated in FIG. 4. As indicated in FIG. 2, the prior art frame had a single tapered region extending down to the lower, arcuate sliding surface. The H-block device 10 of this invention has a downwardly facing, arcuate face 20, while each outer side 16 of the block has a first, curved and inwardly tapered surface region 21 extending downwardly from the flat, upper region of the side face, and a second, curved and inwardly tapered region 23 extending from region 21 down to the lower face 20 at a different angle to region 21. This provides more levels for different sliding angles and stunts.

The H-block device 10 of this invention will be provided in various different materials for different sliding speeds, such as plastic or metal, and can be easily removed and replaced with a new block when the sliding surfaces become worn. This will be much less expensive than replacing the entire frame of the skate, as was necessary in the past when the frame side plates became excessively abraded as a result of sliding and grinding against pavement or the like.

Although an exemplary embodiment of the invention has been described above by way of example only, it will be understood by those skilled in the field that modifications may be made to the disclosed embodiment without departing from the scope of the invention, which is defined by the appended claims.

I claim:

1. An in-line skate apparatus, comprising:

a frame for attachment t the sole of a shoe, the frame having a pair of outer side faces, a front end, a rear end, an a lower edge, and being of predetermined width between said outer side faces;

a plurality of wheels rotatably mounted on the frame in a line from the front end to the rear end of the frame;

the frame having a cut out extending upwardly from said lower edge between an adjacent pair of wheels;

a separate H-block mounted in the cut-out, the H-block being of shape and dimensions matching those of the cut-out such that it fills the cut-out, the H-block having outer side faces and a width at least equal to the width of said frame, and having an arcuate, downwardly directed sliding region extending continuously across its width and along at least part of the height of each side face, whereby the sliding region of the H-block comprises the only sliding surface of the apparatus during sliding maneuvers.

2. The apparatus as claimed in claim 1, wherein the cut-out region in each plate is generally rectangular and ha a height equal to at least half of the overall height of the plate.

3. The apparatus as claimed in claim 1, including a releasable fastener device for releasably mounting the H-lock in the cut-out region of the plates.

4. The apparatus as claimed in claim 1, wherein the outer side faces of the block each have an upper, substantially flat region and at least one curved, tapered portion extending downwardly from said flat region to said lower arcuate face.

5. The apparatus as claimed in claim 4, wherein each outer side face of the block has a first, inwardly tapering portion extending at a first angle from said flat region, and a second, inwardly tapering portion extending at a second angle different from said first angle from the first tapering portion to said lower arcuate face.

6. An in-line skate apparatus, comprising:

a frame for attachment o the undersurface of a shoe, the frame having a pair of spaced, parallel downwardly directed plates;

a plurality of wheels mounted in-line between the plates;

the plates each having n outer flat surface, and a lower edge, each lower edge having an upwardly indented, cut-out region of predetermined height between an adjacent pair of wheels;

a separate H-block mounted between the side plates and aligned with the cut-out regions in the side plates, the H-block having portions extending outwardly into each cut-out region and having outer side faces including flat portions which are flush with the outer surfaces of the respective side plates, the width of the block between the outer flat side face portions being substantially equal to the spacing between the outer flat surfaces of the side plates; and the H-block having a downwardly directed, lower arcuate face extending continuously between the two plates, the lower arcuate face and outer side faces of the H-block together providing a sliding surface for sliding maneuvers.

* * * * *